US006616466B2

(12) United States Patent
Frantum, Jr. et al.

(10) Patent No.: US 6,616,466 B2
(45) Date of Patent: Sep. 9, 2003

(54) LATCH FOR CARD EDGE SOCKET

(75) Inventors: Albert Washington Frantum, Jr., Elizabethtown, PA (US); Michael Deen Bowers, Harrisburg, PA (US); Donald James Summers, Shiremanstown, PA (US); Oliver Patrick Bartholomew, Etters, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/068,376

(22) Filed: Feb. 6, 2002

(65) Prior Publication Data

US 2003/0148646 A1 Aug. 7, 2003

(51) Int. Cl.[7] ..... H01R 13/62
(52) U.S. Cl. ..... 439/157; 439/328
(58) Field of Search ..... 439/328, 327, 439/325, 310, 299, 157, 160

(56) References Cited

U.S. PATENT DOCUMENTS

| | | | | |
|---|---|---|---|---|
| 4,986,765 A | | 1/1991 | Korsunsky et al. | 439/326 |
| 5,443,394 A | * | 8/1995 | Billman et al. | 439/157 |
| 5,470,242 A | | 11/1995 | Cheng et al. | 439/157 |
| 5,690,499 A | | 11/1997 | Howell et al. | 439/157 |
| 5,746,614 A | * | 5/1998 | Cheng et al. | 439/157 |
| 6,027,357 A | | 2/2000 | Howell et al. | 439/326 |

* cited by examiner

*Primary Examiner*—Renee Luebke
(74) *Attorney, Agent, or Firm*—Barley Snyder

(57) ABSTRACT

A latch for use in an electrical connector which controls the movement of the circuit board in directions parallel and perpendicular to the path of insertion of the circuit board. The electrical connector has a dielectric housing with an elongated slot which is dimensioned to receive an edge of a circuit card therein. At least one latch receiving recess is positioned proximate an end of the elongated slot. In many applications, a latch receiving recess is provided at either end of the elongated slot. A first wall of the latch receiving recess is provided adjacent the elongated slot. The first wall has angled surfaces provided thereon. A latch is positioned in the respective latch receiving recess and is pivotally retained therein. Each latch has a pair of legs spaced from each other by a board receiving slot. The legs have a respective tapered surface which extends from a front surface of each leg to a respective side surface. The angle which the tapered surfaces project from the front surface is similar to the angle of the angled surfaces. Whereby when the latch is positioned in locking engagement with the circuit card, the tapered surfaces and angled surfaces cooperate with each other to prevent the movement of the latch and the circuit card in a direction perpendicular to the plane of insertion of the circuit card.

20 Claims, 9 Drawing Sheets

LATCH FOR CARD EDGE SOCKET

FIELD OF THE INVENTION

The invention relates to a latch and extractor for use in an electrical socket. In particular, the invention discloses a latch which minimizes the tilt of the circuit board inserted into the slot of the socket.

BACKGROUND OF THE INVENTION

Electrical sockets having slots for receiving an edge of a circuit card therein are well known in the industry. The sockets generally have latches provided at the ends thereof to maintain a circuit board in the slot of the electrical socket. The sockets are generally of two types, cam-in type sockets in which the circuit board is rotated into position and direct insert sockets in which the circuit board is moved directly into the slot without caming action. Often the latches in the direct insert-type socket also act as extractors.

An example of a direct in socket is shown in U. S. Pat. No. 5,690,499. The patent discloses an electrical socket which has a slot for receiving an edge of a circuit board and a latch/extractor which is movable for dislodging the circuit card from the slot. The socket has a pair of flexible towers, and the extractor has a pair of lateral projections which are received in notches in the towers for locking the extractor in a closed position. The projections have beveled surfaces, and the towers have complementary ramps which are engaged by the beveled surfaces so that the towers are resiliently deflected without damage to the projections. When the extractor is moved to a closed position, edges of a circuit board are maintained between the leg 34 of the extractor. A projection of the extractor also cooperates with a notch in the circuit board to maintain the circuit board in position relative to the socket when the extractor is in the closed position. In so doing, the extractor acts as a latch to maintain the circuit board in position. When the extractor is moved to an open position, the foot cooperates with the bottom of the printed circuit board to help remove the circuit board from the slot of the socket.

While these types of extractors/latches prevent the unwanted removal of the printed circuit board from the socket, these latches do not insure that a positive electrical connection will be maintained between the circuit board and the contacts of the socket. When in use, the sockets and the printed circuit board are exposed to various harmful conditions, such as extreme heat and vibration. As this occurs, the printed circuit board will have a tendency to migrate or rotate from its original position. The prior art latches have been effective to prevent the removal of the circuit board from the socket. However, due to the tolerances required for the manufacture and operation of the latches, the circuit board is able to rotate relative to the contact as the socket and circuit board are exposed to the harsh conditions. If the rotation is not adequately controlled, the electrical connection between the pads of the circuit boards and the contacts of the socket can become intermittent or can fail completely, both of which are unacceptable to the operation of the socket.

It would therefore be beneficial to provide a latch mechanism which minimizes the rotation of the printed circuit board when inserted into the socket. By so doing, the latch would help to insure that a positive electrical connection is effected and maintained over time in various conditions.

SUMMARY OF THE INVENTION

The invention is directed to a latch for use in an electrical connector which controls the movement of the circuit board after the circuit board has been inserted into an elongated board receiving slot provided in the housing. The latch cooperates with the circuit board to prevent the inadvertent removal of the circuit board in a direction parallel to the path of insertion of the circuit board. The latch also prevents the inadvertent removal and unwanted movement of the circuit board in a direction perpendicular to the path of insertion, thereby insuring that a positive electrical connection will be effected and maintained between the electrical connector and the circuit board.

The electrical connector has a dielectric housing with a top surface and an elongated slot which is open through the top surface and which is dimensioned to receive an edge of a circuit card therein. At least one latch receiving recess is positioned proximate an end of the elongated slot. In many applications, a latch receiving recess is provided at either end of the elongated slot. The latch receiving recess extends from the top surface of the housing. A first wall of the latch receiving recess is provided adjacent the elongated slot. The first wall has angled surfaces provided thereon. A latch is positioned in the respective latch receiving recess and is pivotally retained therein. Each latch has a pair of legs spaced from each other by a board receiving slot. The legs have a respective tapered surface which extends from a front surface of each leg to a respective side surface. The angle which the tapered surfaces project from the front surface is similar to the angle of the angled surfaces. Whereby when the latch is positioned in locking engagement with the circuit card, the tapered surfaces and angled surfaces cooperate with each other to prevent the movement of the latch and the circuit card in a direction perpendicular to the plane of insertion of the circuit card.

The board receiving slot extends from a front surface of the latch to a back surface. The board receiving slot is dimensioned to receive an end of the circuit card therein, such that the movement of the circuit card in the board receiving slot is controlled.

Locking projections extend laterally from latch side surfaces in directions opposed from each other. The locking projections have lead-in surfaces provided thereon to facilitate movement of the locking projections into and out of locking cavities provided in the latch receiving recesses.

A slot is provided in a back wall of each of the latch receiving recess. The slot is dimensioned to allow the portions of the back wall and side walls to resiliently deform as needed. A back surface of the latch engages the back wall of the latch receiving recess to define a stop position in which the latch is provided in an open position.

The invention is further directed to an electrical connector having a dielectric housing with a top surface and an elongated slot which is open through the top surface and which is dimensioned to receive an edge of a circuit card. At least one latch receiving recess is positioned proximate an end of the elongated slot. The latch receiving recess extends from the top surface. A first wall of the latch receiving recess is adjacent the elongated slot. The first wall has angled surfaces provided thereon. A latch is positioned in the latch receiving recess and is pivotally retained therein. The latch has a pair of legs which are spaced from each other by a board receiving slot. The board receiving slot is dimensioned to receive an end of the circuit board therein and to cooperate with the end of the circuit board to maintain the circuit board in electrical engagement with contacts provided in the dielectric housing. Each leg has a stabilization surface provided thereon. Whereby when the latch is positioned in locking engagement with the circuit card, the stabilization surfaces and angled surfaces cooperate with each other to prevent the movement of the latch and the circuit card in a direction perpendicular to the plane of insertion of the circuit card.

Each stabilization surface extends at an angle from a front surface of each leg to a respective side surface. The angles which the stabilization surfaces project from the front surface is similar to the angle of the angled surfaces.

The invention is further directed to an electrical connector having a dielectric housing with an elongated slot which is dimensioned to receive an edge of a circuit card. At least one latch receiving recess is positioned proximate an end of the elongated slot. A first wall of the latch receiving recess is adjacent the elongated slot. The first wall has angled surfaces provided thereon. A latch is positioned in the latch receiving recess and is movably retained therein. Each latch has a pair of legs spaced from each other by a board receiving slot. The legs have a respective tapered surface which extends from a front surface of each leg to a respective side surface. The angle which the tapered surfaces project from the front surface is similar to the angle of the angled surfaces. Whereby when the latch is positioned in locking engagement with the circuit card, the tapered surfaces and angled surfaces cooperate with each other to prevent the movement of the latch and the circuit card in a direction perpendicular to the plane of insertion of the circuit card.

DETAILED DESCRIPTION OF THE EMBODIMENT SHOWN

Figure 1:
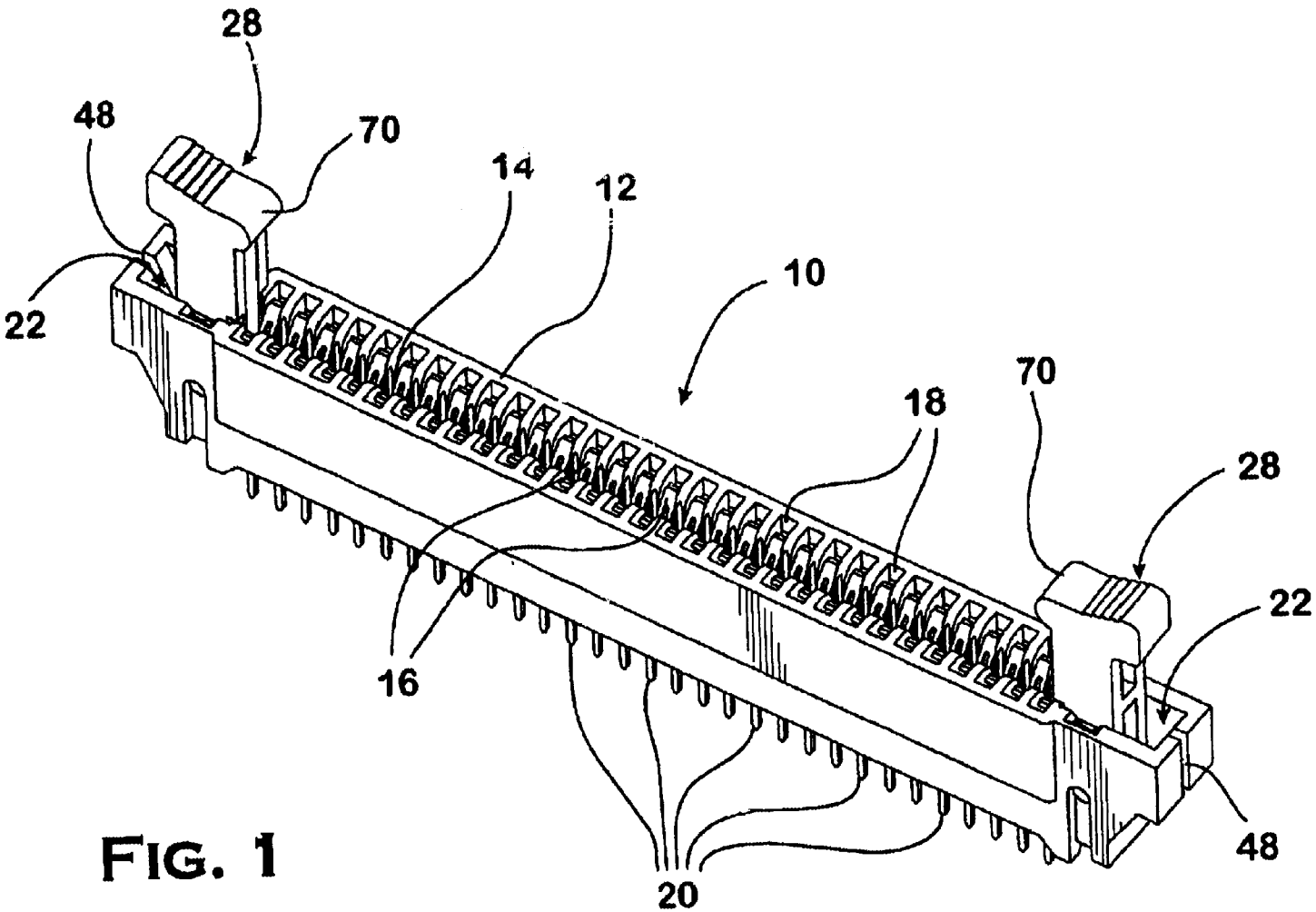
FIG. 1 is a perspective view of an electrical connector having latches provided at both ends thereof.
Figure 2:
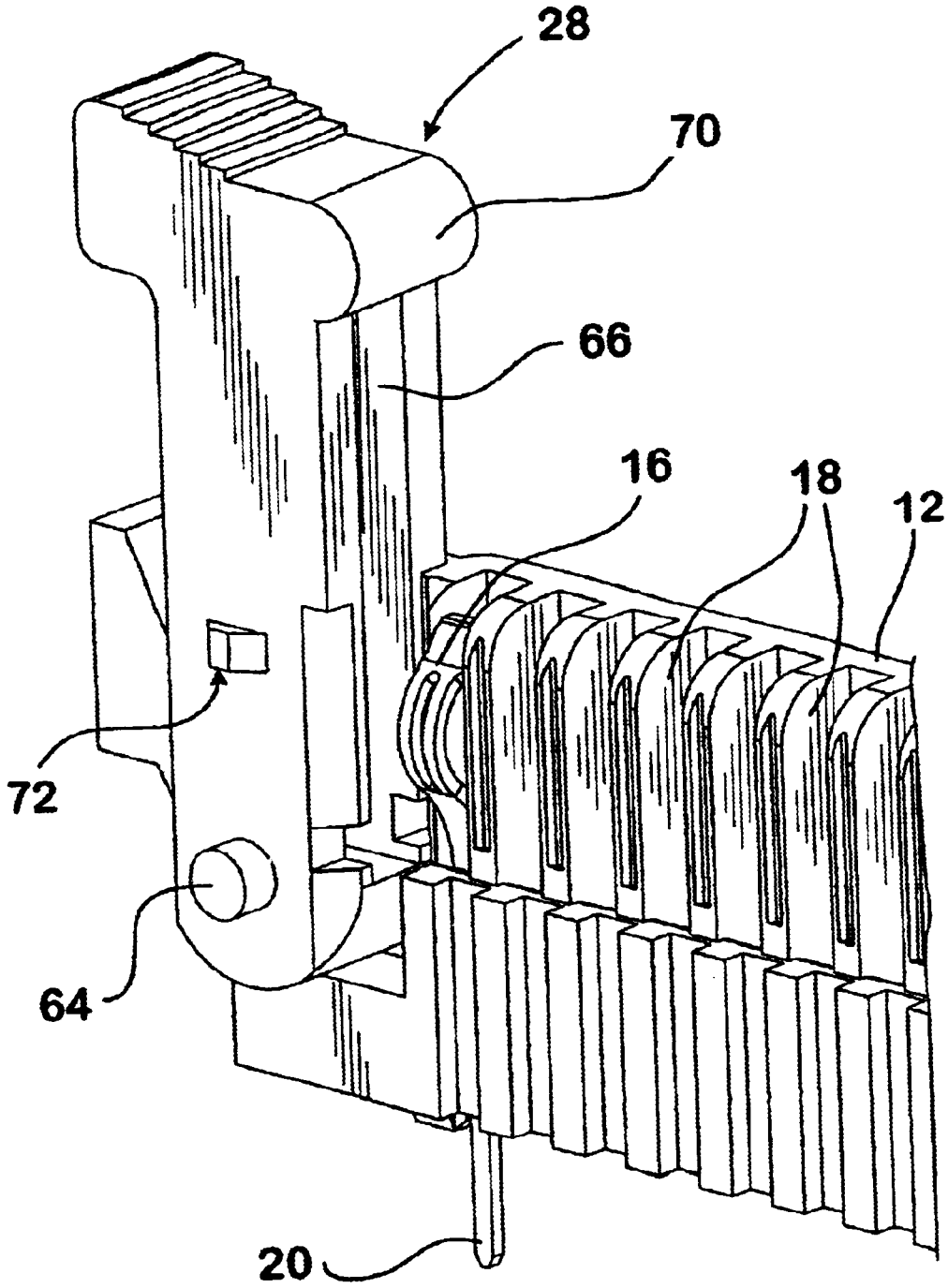
FIG. 2 is a perspective view of an end portion of the electrical connector with a portion of the housing removed to better show a respective latch received in the housing, only one contact is shown for illustrative purposes.

With reference to FIG. 1, an electrical socket or connector has a dielectrical housing 10, having a top surface 12 and an elongated slot 14, which is open through the top surface and is dimensioned for receiving an edge portion of a circuit board daughter card, such as a Dual Inline Memory Module (DIMM). The housing carries a plurality of contacts 16 which are disposed in respective cavities 18 which are open through side walls of the slot 14. The contacts 16 are arranged in two rows on opposite sides of the slot and are spaced apart along the length of the slot. The contacts extend into the slot through the side walls for electrically engaging contact pads on the daughter card which is received in the slot. Each of the contacts 16 has a solder-tail lead 20 which extends from the housing for electrical engagement with a circuit path on a mother board (not shown).

Figure 5:
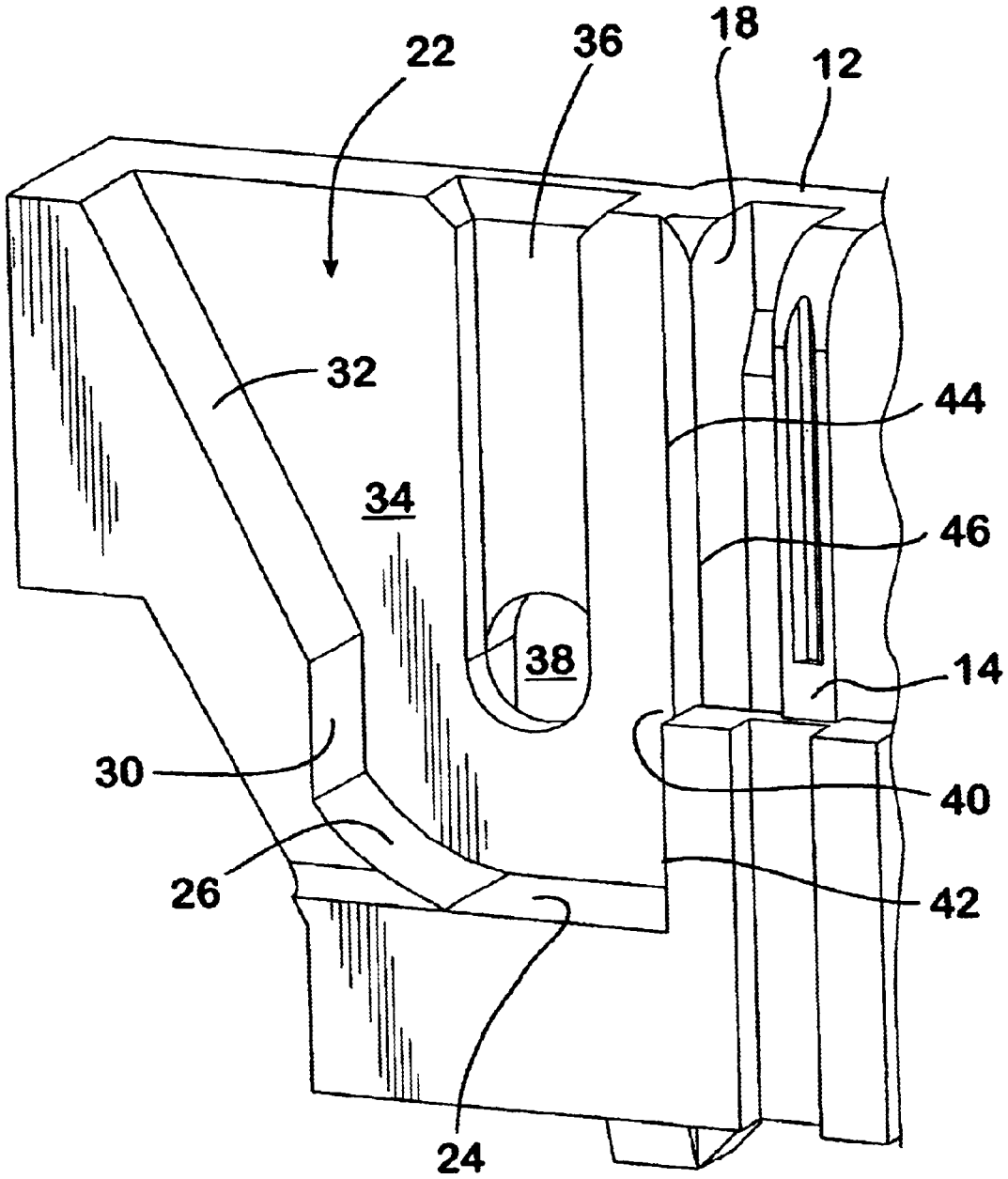
FIG. 5 is a perspective view of a portion of a latch receiving cavity, provided at an end of the housing.

Provided at either end of housing 10 is a latch receiving recess 22. As used herein with reference to the latch receiving recess 22, a front or forward direction is defined as the direction toward slot 14. As best shown in FIG. 5, the latch receiving recess 22 extends from the top surface 12 toward a bottom surface. It should be noted that in FIGS. 2 and 5 through 7, the housing of the electrical connector has been removed to better illustrate the various parts of the recess and latch. The depth of the latch receiving recess 22 from the top surface 12 is greater than the depth of the elongated slot 14. A portion of the bottom wall 24 of the latch receiving recess 22 has an arcuate surface 26. This arcuate surface 26 is configured to allow a latch 28 (FIGS. 6 and 7) provided in the recess 22 to pivot while providing the structural integrity required to maintain the integrity of the housing 10. A vertical back wall 30 extends from the arcuate surface 26. Extending from the vertical back wall 30 to the top surface 12 is an angled back wall 32. The angled back wall 32 is angled with respect to both the vertical back wall 30 and the top surface 12.

Side walls 34 of the latch receiving recess 22 have locking cavities 36 extending therein. The locking cavities 36 are provided proximate the top surface 12 of the housing 10. Openings 38 are also provided in side walls 34. The openings 38 are positioned proximate the arcuate surface 26 and generally in line with the cavities 36.

A front wall 40 of the latch receiving recess 22 has a flat surface 42 which is essentially parallel to the vertical back wall 30. The flat surface 42 extends from the bottom wall 24 toward the top surface 12. However, the flat surface 42 does not extend beyond the bottom of the elongated slot 14. Angled surfaces 44 extend from the flat surface 42 to the side walls 34. Unlike the flat surface 14, the angled surfaces 44 extend from the bottom wall 24 to the top surface 12. Consequently, a gap or recess 46 is provided between the upper portion of the angled surfaces 44.

Figure 8:
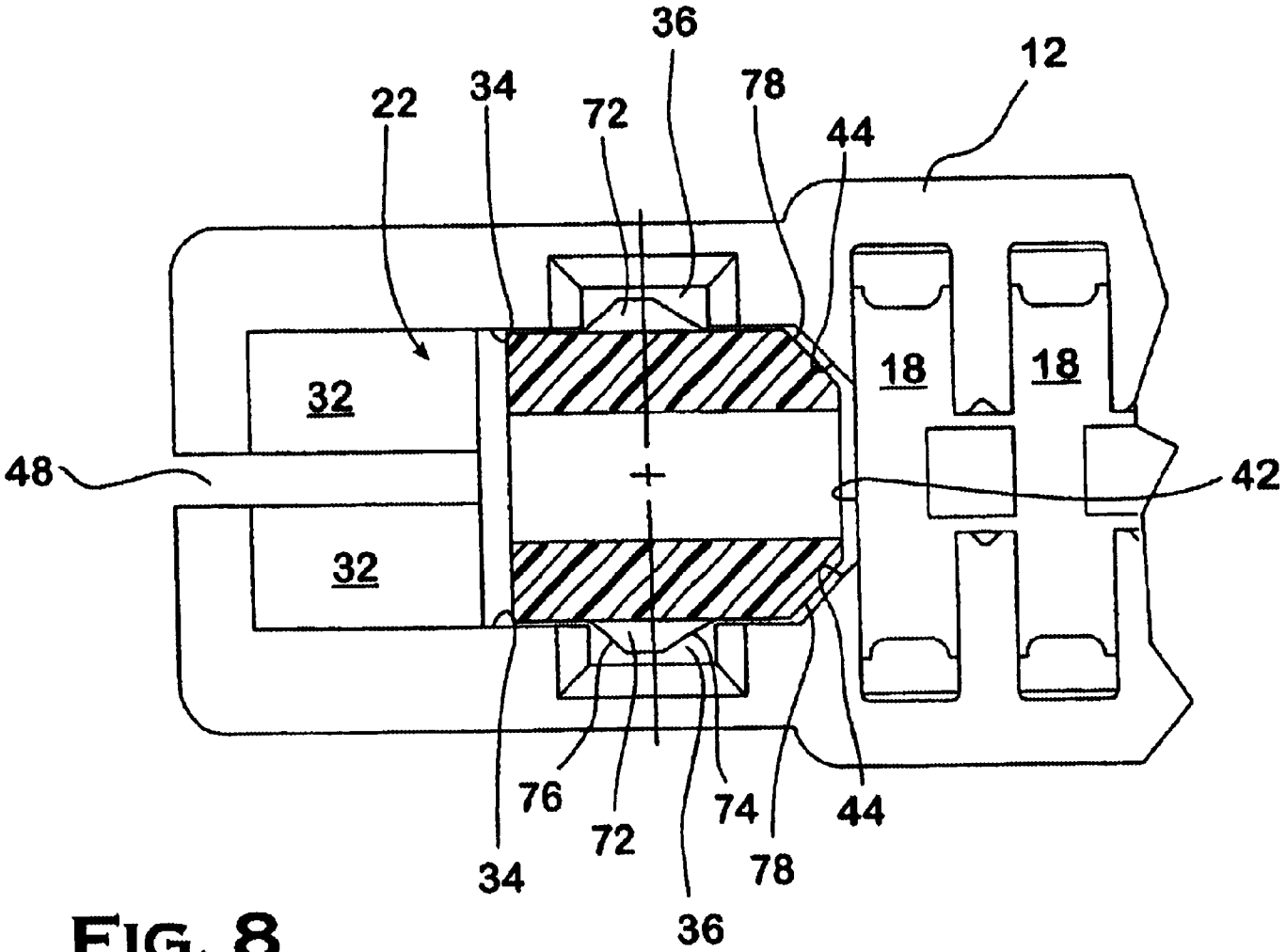
FIG. 8 is a top view of the end portion of the housing.

As best shown in FIGS. 1 and 8, a slot 48 is provided in the back wall 30. The slot extends from the top surface 12 toward the bottom surface. The slot 48 is dimensioned to allow the portions of the back wall 30 and side walls 34 to resiliently deform as required.

The latch 28 is pivotably coupled to the housing 10 at each end of the slot 14, although the invention may be embodied by the housing having only a single latch at one end of the slot. The latch 28 also acts as an extractor as will be more fully discussed.

Figure 3:
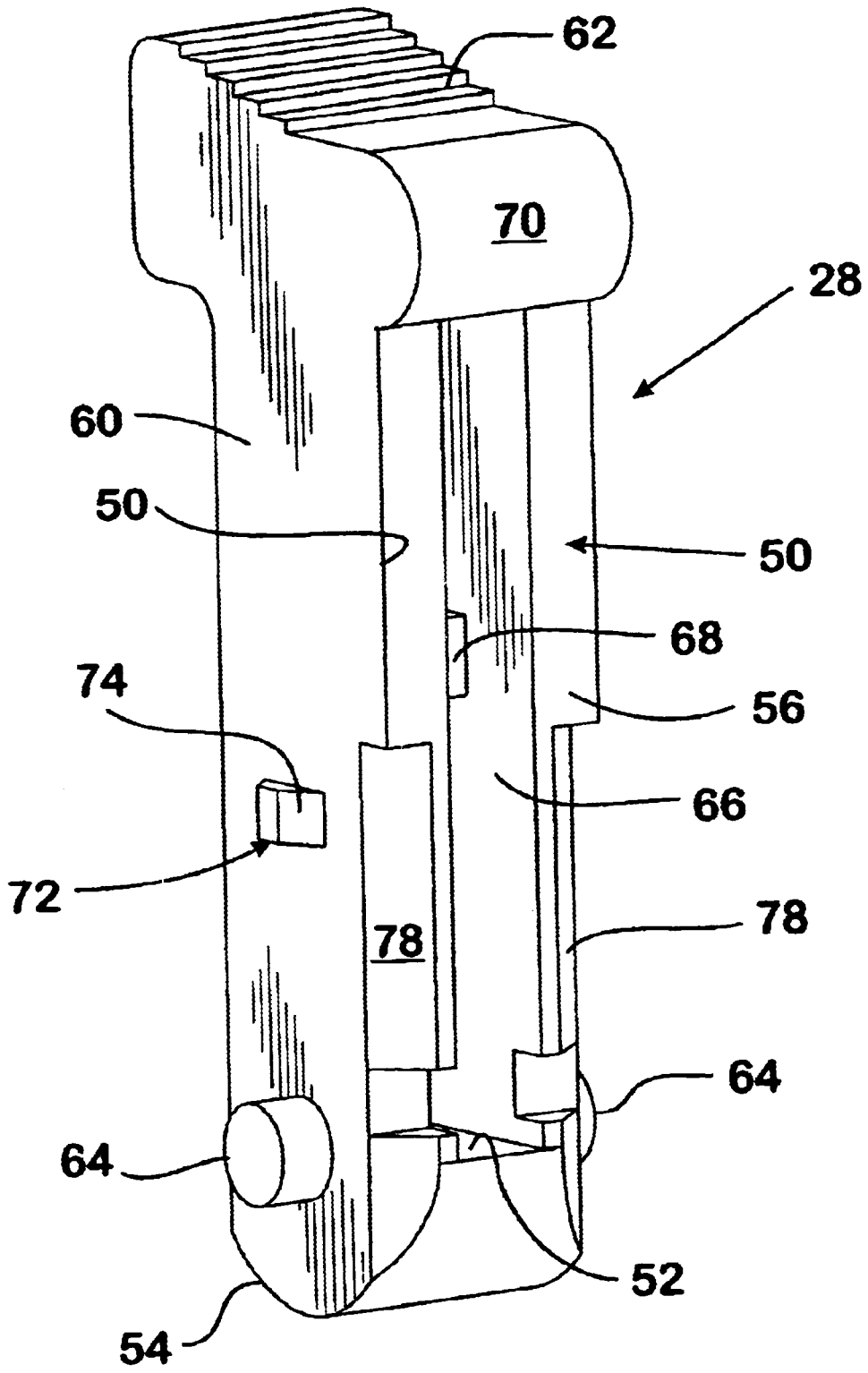
FIG. 3 is a perspective view of the latch removed from the housing, the latch is viewed from a front or board receiving side.
Figure 4:
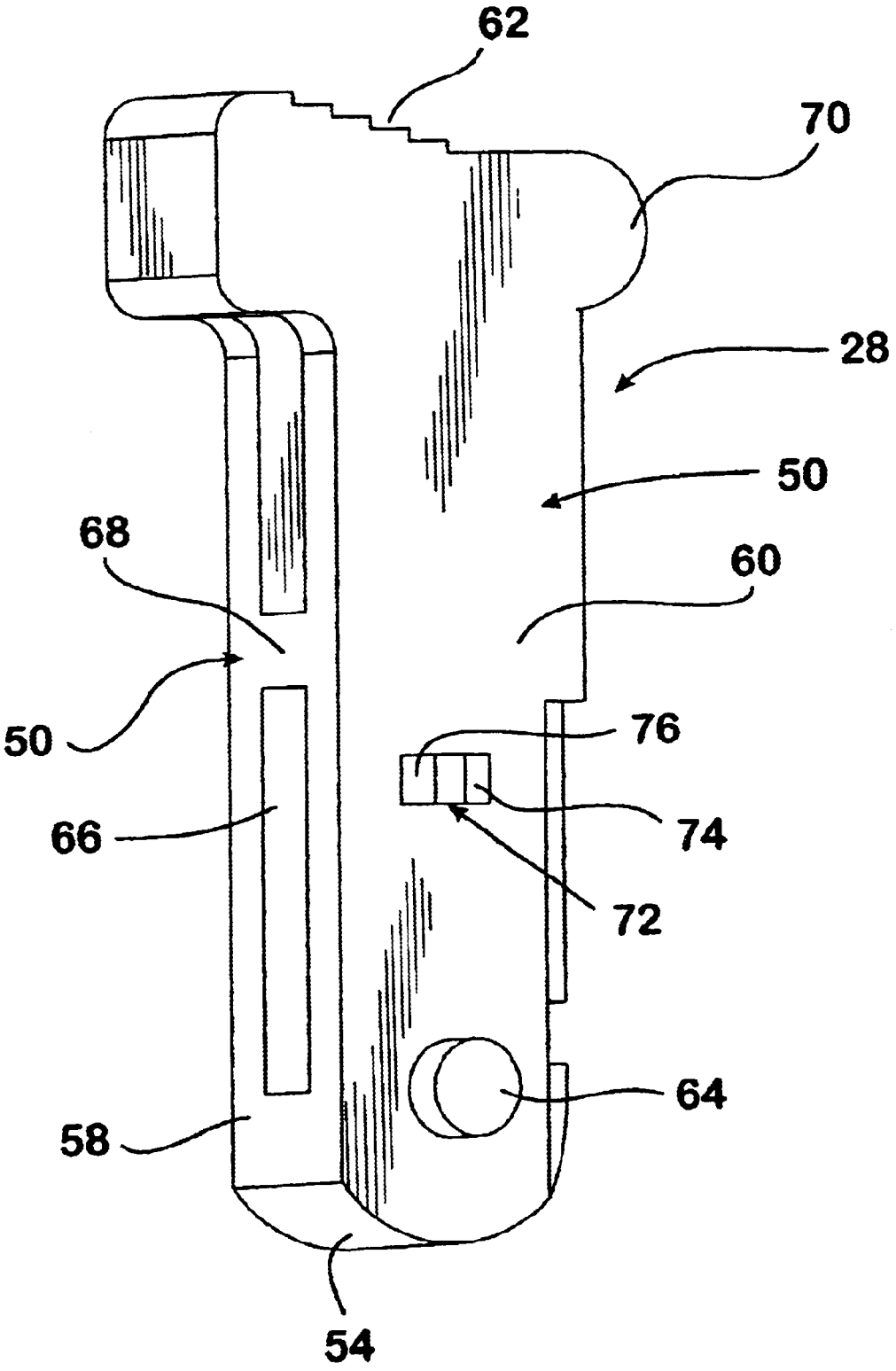
FIG. 4 is a perspective view of the latch as viewed from a back side.

Each of the latches 28, as best shown in FIGS. 3 and 4, has a pair of legs 50 with an ejecting surface 52 extending between the legs. As used herein with reference to each latch, a front or forward direction is defined as the direction toward the slot 14. The latch 28 has a generally arcuate bottom surface 54, front surface 56, back surface 58, side surfaces 60, and a serrated or textured top surface 62. Projections 64 extend laterally from the side surfaces 60 in directions opposed from each other. The projections 64 are received in the complementary openings 38 in the housing 10. The projections and openings have generally circular cross-sections, thereby allowing the projections to rotate relative to the openings.

A board receiving slot 66 extends from the front surface 56 to the back surface 58 of the latch 28. The legs 50 extend on either side of slot 66 and the ejecting surface 52 is positioned at the bottom of the slot. A support member 68 extends in the slot 66. The support member 68 extends from and is integral with the legs 50.

Proximate the top surface 62, a latching projection 70 extends from the front surface 56 in a direction away from the back surface 58. The latching projection 70 cooperates with a recess in the daughter card when the latch is rotated to a closed or latched position. By positioning the latch projection 70 in the daughter card recess, the daughter card will be maintained in position relative to the housing 10.

Locking projections 72 extend laterally from the side surfaces 60 in directions opposed from each other. The locking projections 72 are positioned generally in line with the projections 64. The locking projections 72 have lead-in surfaces 74, 76 provided thereon. Although the lead-in surfaces 74, 76 have similar angles of inclination in the embodiment shown, the lead-in surfaces 74, 76 may be altered to have different angles of inclination.

As best shown in FIGS. 3 and 8, tapered surfaces 78 are provided on legs 50. The tapered surfaces 78 extend from the front surface 56 to respective side surfaces 60. The slope of the tapered surfaces 78 is similar to the slope of the angled surfaces 44 of the front wall 40 of the latch-receiving recess 22.

The latch 28 and housing 10 are molded separately and assembled together. During assembly, the latch 28 is inserted into the latch-receiving recess 22 from the top surface 12. As this occurs, the projections 64 of the latch 28 engage side walls of the locking cavities of the latch-receiving recess 22. This causes the side walls 34 of the latch-receiving recess to resiliently deform outward, allowing the projections 64 and latch 28 to be moved toward the bottom wall 24 of the recess 22. This insertion is continued until the projections 64 align with and are received in openings 28. With projections 64 and openings 38 aligned, the side walls 34 return to their unstressed position, thereby securing the latch 28 in the recess 22. The resiliency of the side walls 34 is facilitated by the incorporation of the slot 48 in the back wall 30. The slot 48 allows the back wall 30 to be less rigid and, consequently, allows the side walls 34 to deflect more easily.

As previously discussed, the projections 64 and openings 38 have generally circular sections. Therefore, the projections 64 are able to turn in the openings 38 allowing the latch 28 to rotate relative to the recess 22 between an open position (shown in FIG. 7) and a closed or latched position (shown in FIG. 6).

Figure 7:
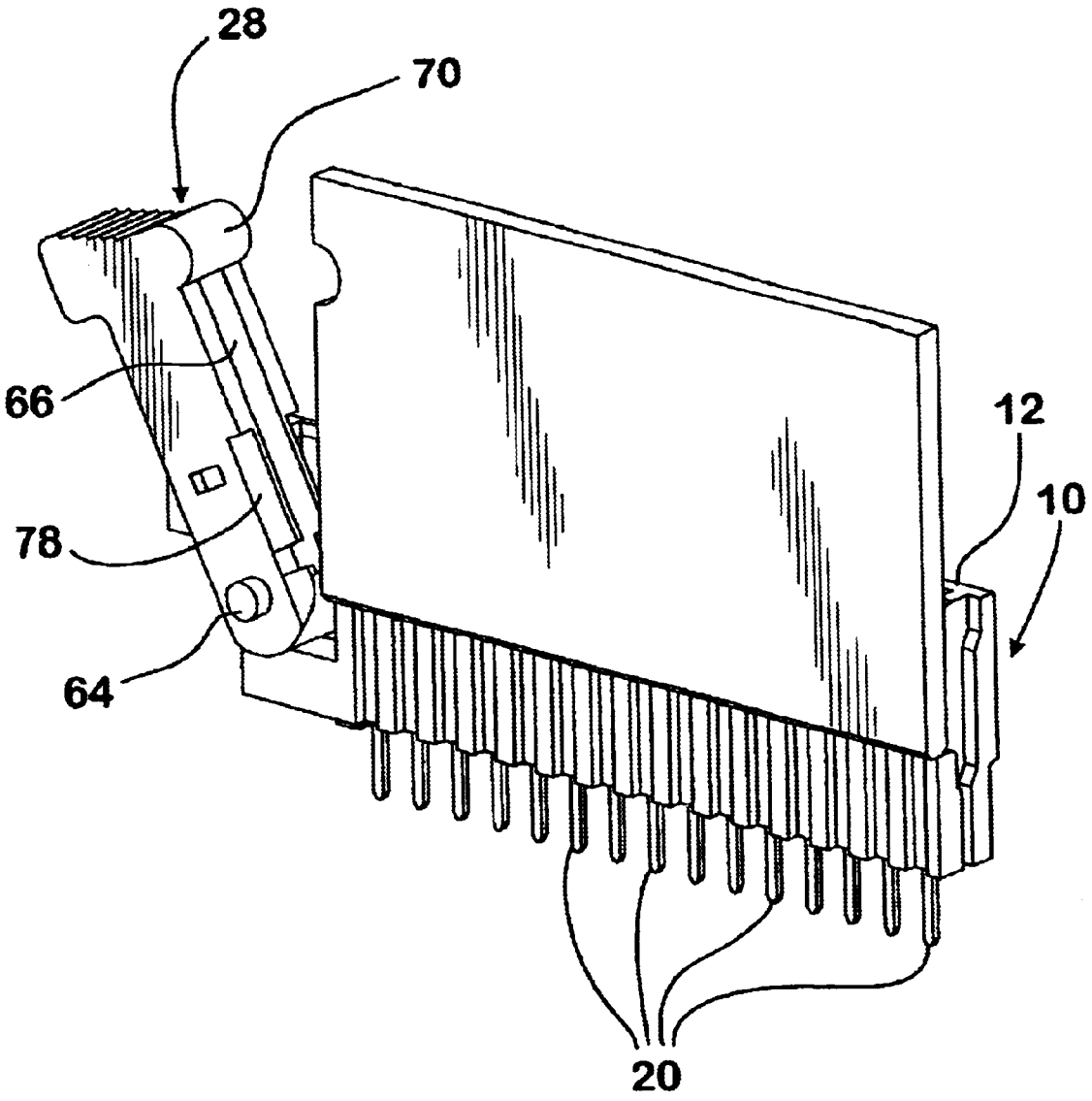
FIG. 7 is a perspective view similar to FIG. 6 showing the latch in an open position.

Referring to FIG. 7, when the latch 28 is in the open position, the back surface 58 of the latch 28 engages the angled back wall 32 of the recess 22. This defines a positive stop position. By so doing, the latch 28 will be maintained in an optimum position to allow for the insertion of the daughter card into the elongated slot 14 of the housing 10. In this open position, the latching projection 70 and the majority of the tapered surfaces 78 are positioned outside of the path of insertion of the daughter card. In contrast, the ejecting surface 52 is positioned in the path of insertion.

As the insertion of the daughter card occurs, a leading edge of the daughter card engages the ejecting surface 52 causing the ejecting surface 52 to pivot about projections 64 in a counter-clockwise direction. This in turn causes the entire latch 28 to pivot about the projections 64 in a counter-clockwise direction. As this rotation occurs, the locking projections 72 cause the side walls 34 to resiliently deform, allowing the latching projection 70 and tapered surfaces 78 of legs 50 to be moved toward the daughter card. This continues until the daughter board is fully inserted into the slot 14. When this occurs, the latch 28 is moved slightly further to lock the latch 28 in the closed position. A force is applied to the latch to move the locking projections 72 into the locking cavities 36 of the side walls 34. This allows the side wall to return to an unstressed position and positively lock the latch 28 in the closed position.

In this fully closed or latched position, the latching projection 70 is positioned in the recess of the daughter card to prevent the inadvertent removal of the daughter card from the slot 14. The ejecting surface 52 is positioned proximate to the leading edge of the daughter card. In general, the ejecting surface will be slightly spaced from the leading edge when the latch 28 is in the fully closed or latched position.

Figure 6:
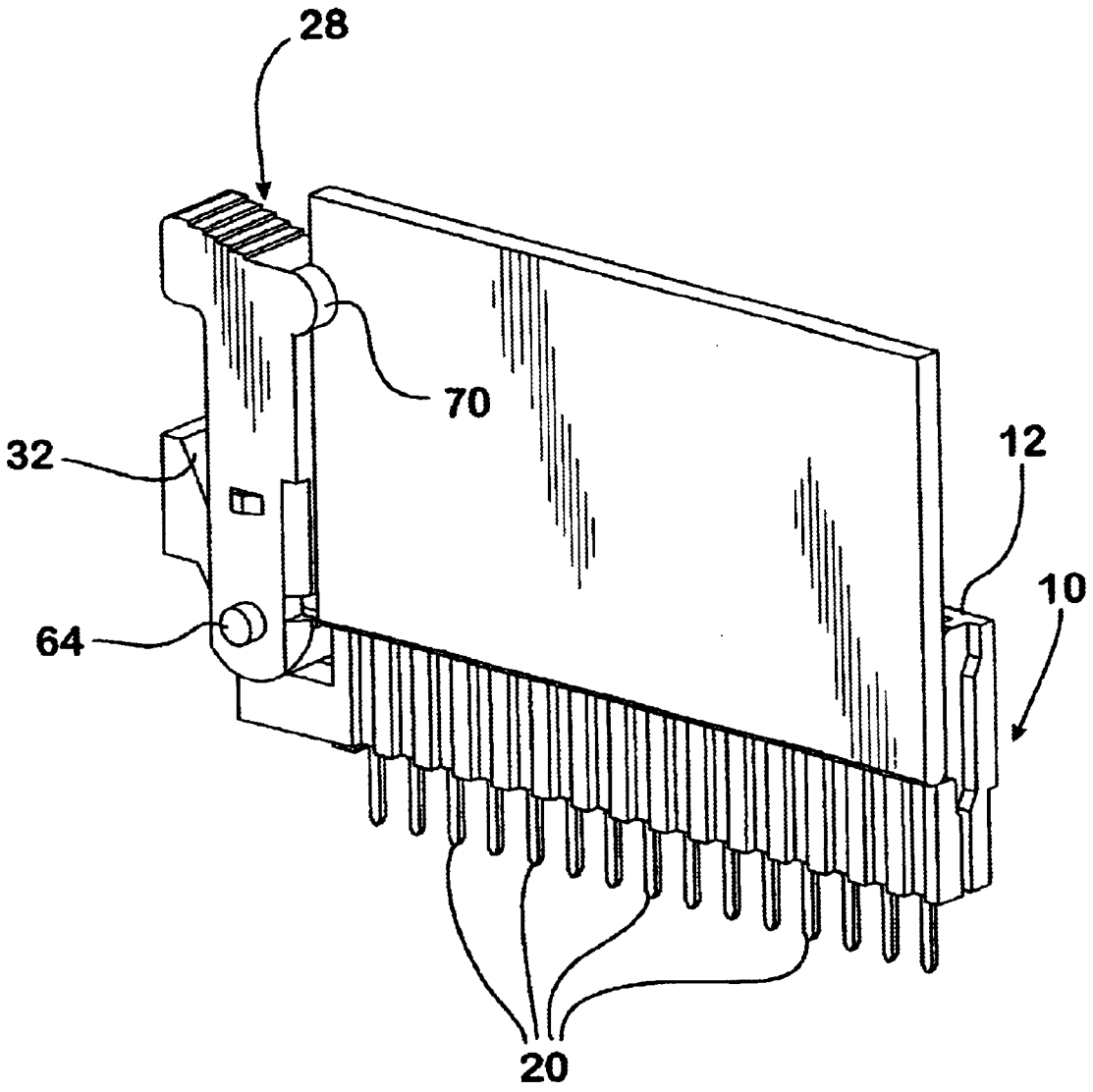
FIG. 6 is a perspective view similar to FIG. 2 with a daughter board inserted in the connector and the latch shown in a closed or latched position.

Referring to FIGS. 6, when in the latched position, portions of the side edges of the daughter card are positioned in the board receiving slots 66 of the latches 28. The tapered surfaces 78 extend beyond the side edges of the daughter card, thereby essentially trapping the side edges in the slots 66. In this position, the tapered surfaces 78 are provided proximate the angled surfaces 44 of the front walls 40 of the recesses 22.

When in the latched position, the tapered surfaces 78 are provided adjacent to the angled surfaces 44. The tapered surfaces 78 and angled surfaces 44 are maintained in adjacent relationship, as the locking projections 72 are retained in the locking cavities 36, thereby preventing the inadvertent movement of the latch 28 relative to the housing 10. In other words, the positioning of the locking projections 72 in the locking cavities 36 prevents the backward rotation of the latch 28 to the open or insertion position. However, the forces of locking projections 72 can be overcome if a sufficient force is applied to the latch 28, thereby allowing for the extraction of the daughter board from the housing 10, as will be more fully discussed.

Figure 9:
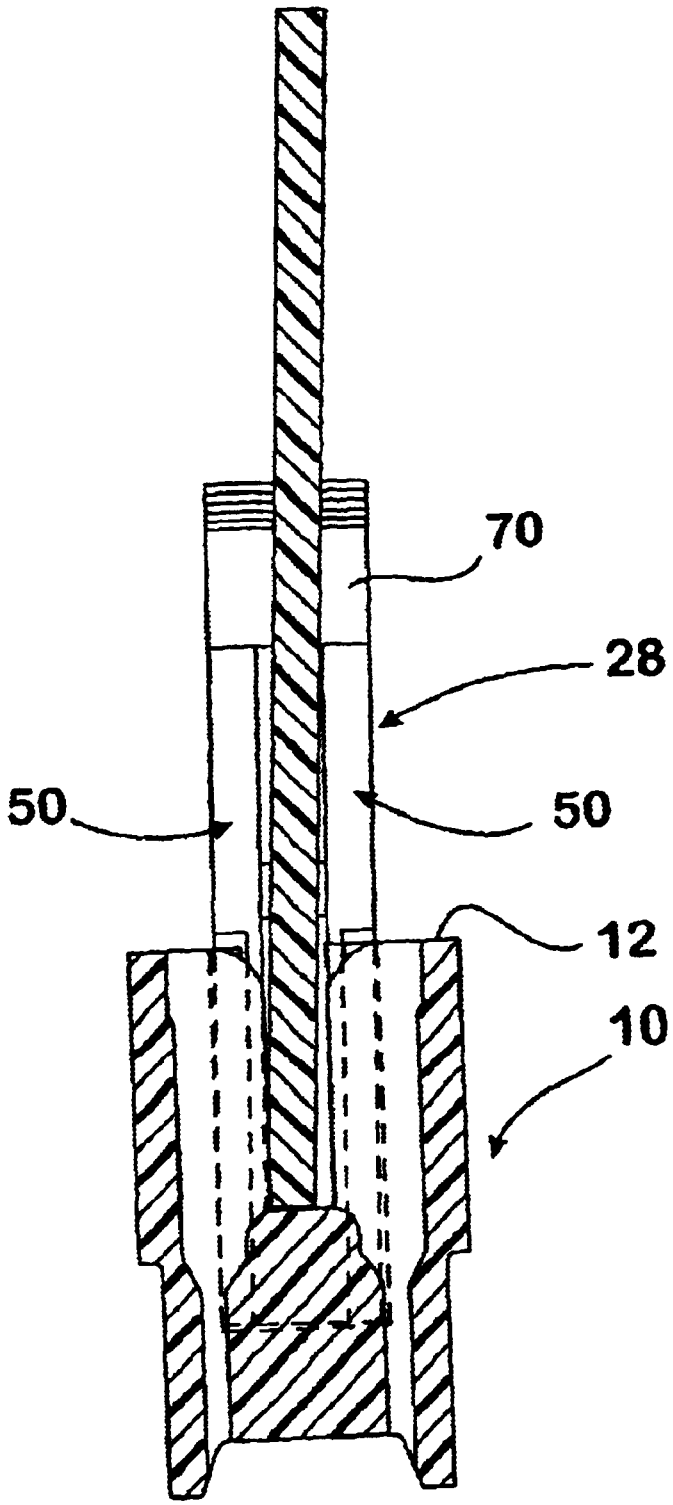
FIG. 9 is a diagrammatic cross sectional view illustrating the limited movement, in a direction perpendicular to the path of insertion, of the circuit board relative to the housing.

With the latch 28 in the fully latched position, the cooperation of the locking projections 72 and cavities 36 and the cooperation of the angled surfaces 44 with the tapered surfaces 78 maintain the latch 28 in a well defined area. In other words, the cooperation of the locking projections 72 and cavities 36 causes the latch 28 to be maintained in a position in which the angled surfaces 44 and the tapered surfaces 78 are maintained in extremely close proximity to each other. In fact, the surfaces 44, 78 may be in engagement. As the surfaces 44, 78 are in close proximity, the surfaces cooperate to prevent the latch 28 from being pivoted too far toward the daughter card. In addition, as the surfaces 44, 78 are angled, the movement of the latch 28 toward the side walls 34 of the latching receiving recess 22 (or perpendicular to the insertion of the daughter board) is controlled, as is best shown in FIG. 9. In the prior art connectors, which do not have angled surfaces 44 or tapered surfaces 78, the movement of the latch 28 in the direction perpendicular to the daughter board is difficult to control. As prior art connectors have traditional perpendicular surfaces, the movement or "play" in the latch is significant. As it is difficult and expensive to control the tolerances of the latching receiving recess and the latch, prior art latches do not have the precision necessary to control the "play" of the latch. As the daughter board is positioned in the slot 14, the board has a tendency to rotate or move relative to the slot, particularly when the assembly is exposed to harsh environments (including temperature fluctuations and vibrations). This problem worsens as the dimensions of the board are increased. While prior art connectors provided some stability, the connections between the boards and the contacts of connectors still experience intermittent electrical problems, as the latches of the prior art still allow for sufficient movement of the board to cause the board to electrically disengage from the connector in harsh environment.

In contrast, as the angled surfaces 44 and tapered surfaces 78 of the present invention cooperate, the latch 28 is prevented from significant movement perpendicular to the line of insertion of the board. Consequently, as the board is positioned in the slot 66, the configuration of the latch 28 limits the movement of the daughter board.

As discussed, the angled surfaces 44 and tapered surfaces 78 cooperate to maintain the latch 28 in position. As the surfaces 44, 78 are angled, the tolerance of each surface does not have to be precisely controlled. The angled surfaces 44 allow any part thereof to engage the tapered surfaces 78 to prevent the lateral movement of the latch 28. Additionally, angled surfaces 44 act as a lead-in to insure that as the latch 28 is rotated to a closed position, the tapered surfaces 78 will cooperate with the angled surfaces 44 to insure that the latch 28 will be precisely positioned when in the latched position.

The precise and repeatable position of the latch 28 allows the slot 66 to be precisely and repeatably positioned relative to the daughter board. Consequently, the dimension (width) of the slot can be narrower than in previous latches, as the latch does not need to have the ability to compensate for the misalignment of the latch. As shown in the figures, the legs 50 on the sides of the narrow slot 66 provide adequate support for the daughter card and control the rotation of the card so that a positive electrical connection is effected and maintained.

In order to extract the daughter card from the slot 14 of the housing 10, a force is applied to the latch 28 to move the locking projections 72 from the locking cavities 36 so that the latch 28 can be rotated or pivoted in the reverse direction. As this occurs, the ejecting surface 52 cooperates with the leading edge of the daughter card to move the leading edge toward the top surface 12 of the housing 10. The daughter card can then be extracted from the housing 10.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. An electrical connector comprising:

a dielectric housing having a top surface and an elongated slot which is open through the top surface and dimensioned to receive an edge of a circuit card;

at least one latch receiving recess positioned proximate an end of the elongated slot, the at least one latch receiving recess extends from the top surface, a first wall of the at least one latch receiving recess is adjacent the elongated slot, the first wall has angled surfaces provided thereon;

a latch positioned in the at least one latch receiving recess and pivotally retained therein, the latch having a pair of legs spaced from each other by a board receiving slot, each leg has a tapered surface which extends from a front surface of each leg to a respective side surface, the angle which the tapered surfaces project from the front surface is similar to the angle of the angled surfaces;

whereby when the latch is positioned in locking engagement with the circuit card, the tapered surfaces and angled surfaces cooperate with each other to prevent the movement of the latch and the circuit card in a direction perpendicular to the plane of insertion of the circuit card.

2. The electrical connector as recited in claim 1 wherein the first wall of the at least one latch receiving recess has a flat surface which extends from a bottom wall of the at least one latch receiving recess toward the top surface, the angled surfaces extend from the flat surface to side walls of the at least one latch receiving recess.

3. The electrical connector as recited in claim 1 wherein an ejecting surface is provided at the lower end of the board receiving slot.

4. The electrical connector as recited in claim 1 wherein the board receiving slot extends from a front surface of the latch to a back surface, the board receiving slot is dimensioned to receive an end of the circuit card therein, such that the movement of the circuit card in the board receiving slot is controlled.

5. The electrical connector as recited in claim 4 wherein a support member extends in the slot and is integral with the legs of the latch.

6. The electrical connector as recited in claim 1 wherein a latching projection extends from the front surface of the latch to cooperate a recess in the end of the circuit card when the latch is rotated to a latched position.

7. The electrical connector as recited in claim 1 wherein locking projections extend laterally from latch side surfaces in directions opposed from each other, the locking projections have lead-in surfaces provided thereon to facilitate movement of the locking projections into and out of locking cavities in the at least one latch receiving recess.

8. The electrical connector as recited in claim 1 wherein a slot is provided in a back wall of the at least one latch receiving recess, the slot is dimensioned to allow the portions of the back wall and side walls to resiliently deform as needed.

9. The electrical connector as recited in claim 8 wherein a back surface of the latch engages the back wall of the at least one latch receiving recess to define a stop position in which the latch is provided in an open position.

10. An electrical connector comprising:

a dielectric housing having a top surface and an elongated slot which is open through the top surface and dimensioned to receive an edge of a circuit card;

at least one latch receiving recess positioned proximate an end of the elongated slot, the at least one latch receiving recess extends from the top surface, a first wall of the at least one latch receiving recess is adjacent the elongated slot, the first wall has angled surfaces provided thereon;

a latch positioned in the at least one latch receiving recess and pivotally retained therein, the latch having a pair of legs spaced from each other by a board receiving slot, the board receiving slot is dimensioned to receive an end of the circuit board and cooperate with the side edge of the circuit board to maintain the circuit board in electrical engagement with contacts provided in the dielectric housing, each leg has a stabilization surface;

whereby when the latch is positioned in locking engagement with the circuit card, the stabilization surfaces and angled surfaces cooperate with each other to prevent the movement of the latch and the circuit card in a direction perpendicular to the plane of insertion of the circuit card.

11. The electrical connector as recited in claim 10 wherein the first wall of the at least one latch receiving recess has a flat surface which extends from a bottom wall of the at least one latch receiving recess toward the top surface, the angled surfaces extend from the flat surface to side walls of the at least one latch receiving recess.

12. The electrical connector as recited in claim 10 wherein an ejecting surface is provided at the lower end of the board receiving slot.

13. The electrical connector as recited in claim 10 wherein the board receiving slot extends from a front surface of the latch to a back surface.

14. The electrical connector as recited in claim 13 wherein a support member extends in the slot and is integral with the legs of the latch.

15. The electrical connector as recited in claim 10 wherein each stabilization surface extends at an angle from a front surface of each leg to a respective side surface, the angles which the stabilization surfaces project from the front surface is similar to the angle of the angled surfaces.

16. The electrical connector as recited in claim 10 wherein a latching projection extends from the front surface of the latch to cooperate a recess in the end of the circuit card when the latch is rotated to a latched position.

17. The electrical connector as recited in claim 10 wherein locking projections extend laterally from latch side surfaces in directions opposed from each other, the locking projections have lead-in surfaces provided thereon to facilitate movement of the locking projections into and out of locking cavities in the at least one latch receiving recess.

18. The electrical connector as recited in claim 10 wherein a slot is provided in a back wall of the at least one latch receiving recess, the slot is dimensioned to allow the portions of the back wall and side walls to resiliently deform as needed.

19. The electrical connector as recited in claim 18 wherein a back surface of the latch engages the back wall of the at least one latch receiving recess to define a stop position in which the latch is provided in an open position.

20. An electrical connector comprising:

a dielectric housing having an elongated slot which is dimensioned to receive an edge of a circuit card;

at least one latch receiving recess positioned proximate an end of the elongated slot, a first wall of the at least one latch receiving recess is adjacent the elongated slot, the first wall has angled surfaces provided thereon;

a latch positioned in the at least one latch receiving recess and movably retained therein, the latch having a pair of legs spaced from each other by a board receiving slot, each leg has a tapered surface which extends from a front surface to a respective side surface, the angle which the tapered surfaces project from the front surface is similar to the angle of the angled surfaces;

whereby when the latch is positioned in locking engagement with the circuit card, the tapered surfaces and angled surfaces cooperate with each other to prevent the movement of the latch and the circuit card in a direction perpendicular to the plane of insertion of the circuit card.

* * * * *